US009402498B2

(12) United States Patent
McRae

(10) Patent No.: US 9,402,498 B2
(45) Date of Patent: Aug. 2, 2016

(54) SAFETY GROUNDED TREE

(71) Applicant: National Tree Company, Cranford, NJ (US)

(72) Inventor: Michael M. McRae, Ormond Beach, FL (US)

( * ) Notice: Subject to any disclaimer, the term of this patent is extended or adjusted under 35 U.S.C. 154(b) by 54 days.

(21) Appl. No.: 14/317,291

(22) Filed: Jun. 27, 2014

(65) Prior Publication Data

US 2015/0374159 A1 Dec. 31, 2015

(51) Int. Cl.

| | |
|---|---|
| ***H01R 13/648*** | (2006.01) |
| ***A47G 33/06*** | (2006.01) |
| ***A47G 33/08*** | (2006.01) |
| ***H01R 13/652*** | (2006.01) |
| *H01R 13/24* | (2006.01) |
| *H01R 24/22* | (2011.01) |
| *H01R 24/30* | (2011.01) |

(52) U.S. Cl.

CPC ..... *A47G 33/06* (2013.01); *A47G 33/0872* (2013.01); *H01R 13/648* (2013.01); *H01R 13/652* (2013.01); *A47G 2033/0827* (2013.01); *A47G 2200/08* (2013.01); *H01R 13/2442* (2013.01); *H01R 24/22* (2013.01); *H01R 24/30* (2013.01)

(58) Field of Classification Search

CPC ..... H01R 13/648; H01R 13/658; H01R 13/65802; H01R 4/643; A01N 3/00; A41G 1/00

USPC ..... 439/95, 100, 108; 362/123

See application file for complete search history.

(56) References Cited

U.S. PATENT DOCUMENTS

| | | | | |
|---|---|---|---|---|
| 4,072,857 | A * | 2/1978 | DeVicaris | A41G 1/005 362/123 |
| 4,579,405 | A * | 4/1986 | Hirooka | H01R 9/2491 439/106 |
| 8,053,042 | B1 * | 11/2011 | Loomis | A47G 33/06 362/123 |
| 8,454,186 | B2 * | 6/2013 | Chen | F21S 4/001 362/122 |
| 8,876,321 | B2 * | 11/2014 | Chen | F21V 33/00 362/123 |
| 9,220,361 | B1 * | 12/2015 | Chen | F21S 4/001 |

* cited by examiner

*Primary Examiner* — Hien Vu

(74) *Attorney, Agent, or Firm* — James M. Smedley LLC; James Michael Smedley, Esq.

(57) ABSTRACT

An artificial lighted tree is presented with power routed through the trunk of the tree and three-wire safety grounding. The tree is divided into sections for easy assembly, disassembly, and storage. Safety electrical connectors at the ends of each section are not powered until the sections are assembled. The tree can also accommodate multiple lighting circuits utilizing different voltages simultaneously.

6 Claims, 6 Drawing Sheets

SAFETY GROUNDED TREE

FIELD OF THE INVENTION

The present invention generally relates to artificial lighted trees. Specifically, embodiments of the present invention provide for a decorative lighted Christmas tree with power routed through the trunk of the tree and three-wire safety grounding. The tree is divided into sections for easy assembly, disassembly, and storage. Safety electrical contacts at the ends of each section are not powered until the sections are assembled. The tree can also accommodate multiple lighting circuits utilizing different voltages simultaneously.

BACKGROUND OF THE INVENTION

Seasonal lights, such as those used in conjunction with Christmas trees, are well known in the art. These seasonal lights generally use two-wire conductors to provide power to each of the light bulbs on a particular strand. Since insulation covers the entire length of the wire and plug, risk of shock is minimal so grounding is not a major issue.

Further, artificial pre-lighted Christmas trees, where the seasonal lights are incorporated on or with the tree, have become a popular alternative to both live trees and unlighted artificial trees. These trees are usually sectional for easy storage, with some lighted trees routing power for the lights up through the trunk of the tree with electrical connectors built into the ends of each tree section to distribute power to each section. This mechanism, although convenient, brings with it the risk of exposed conductors at every electrical junction. If these exposed wires accidentally make contact with any other portion of the artificial tree, there is a risk of electric shock and other undesirable electrical dangers (e.g., fire).

Therefore, there is a need in the art for a lighted artificial Christmas tree with a 3-wire safety ground and electrical connectors which prevent electric shock when the contacts are accidentally touched. These and other features and advantages of the present invention will be explained and will become obvious to one skilled in the art through the summary of the invention that follows.

SUMMARY OF THE INVENTION

Accordingly, it is an object of the present invention to provide an artificial lighted tree with power routed through a hollow trunk and three-wire electrical grounding, where the trunk itself is conductive and grounded.

It is also an object of the present invention to provide an artificial lighted tree where the trunk is divided into sections and safety electrical connectors at the end of each section prevent power from being connected to the exposed contacts at the top end of any trunk section until the bottom end of another trunk section is connected to it.

It is also an object of the present invention to provide a multi-conductor system in the artificial lighted tree which is capable of carrying a variety of different voltages allowing for different types of lights to be used on the same tree.

According to an embodiment of the present invention, a lighted artificial tree comprising a base configured to receive and hold a trunk. The trunk comprises a hollow body having an electrically conductive wall, one or more inner electrical conductors situated inside the hollow body, one or more side electrical connectors accessible from the outside of the hollow body and electrically connected to said inner electrical conductors, a ground conductor, electrically connected to the electrically conductive wall of the trunk, and a branch holding mechanism configured to attach one or more artificial tree branches to the trunk.

According to an embodiment of the present invention, the trunk comprises two or more trunk sections. Each trunk section comprises a hollow body having an electrically conductive wall, a male electrical connector attached inside a first end of the hollow body, and a female electrical connector attached inside a second end of the hollow body. The first end of one trunk section connects to the second end of a second trunk section causing the male electrical connector to connect to the female electrical connector and electrically connecting the electrically conductive walls of the first trunk section and the second trunk section. One or more inner electrical conductors connect the female connector to the male connector within a trunk section.

According to an embodiment of the present invention, the electrically conductive wall of the first trunk section makes a direct electrical connection with the electrically conductive wall of the second trunk section when the two trunk sections are connected together.

According to an embodiment of the present invention, the male electrical connector comprises a male ground contact corresponding to a female ground contact in the female electrical connector for creating an electrical connection between the electrically conductive walls of the first trunk section and the second trunk section.

According to an embodiment of the present invention, a limiting collar controls proper insertion depth between the first trunk section and the second trunk section.

According to an embodiment of the present invention, the male electrical connector comprises a center male contact terminal, and one or more side male contact terminals. The female electrical connector comprises a fixed center terminal, a movable center safety contact configured to move into electrical contact with the fixed center terminal when the center male contact terminal contacts the movable center safety contact, one or more fixed side terminals, and one or more movable side safety contacts configured to move into electrical contact with the fixed side terminal when the side male contact terminal contacts the movable side safety contact.

According to an embodiment of the present invention, the movable center safety contact and the movable side safety contacts are not energized until the male electrical connector and the female electrical connector are connected together causing the movable center safety contact to move into contact with the fixed center terminal and one or more movable side safety contacts to move into contact with one or more fixed side terminals.

According to an embodiment of the present invention, the side male contact terminal is a cylindrical contact ring; and the movable side safety contacts are arranged symmetrically such that the female electrical connector and the male electrical connector are capable of connecting in a plurality of rotational orientations to produce redundant electrical contact between the cylindrical contact ring and the plurality of movable side safety contacts.

According to an embodiment of the present invention, the male electrical connector further comprises a plurality of side male contact terminals. The female electrical connector further comprises a plurality of fixed side terminals, a plurality of movable side safety contacts, and a plurality of independent conductors each connected to one of the plurality of fixed side terminals. The first end of the first trunk section connects to the second end of the second trunk section in only a single orientation by means of a keying mechanism in at least one of a) the trunk sections; or b) the electrical connectors.

According to an embodiment of the present invention, the tree has multiple independent power conductors for running a plurality of different voltages.

According to an embodiment of the present invention, the tree further comprises a foot pedal configured for at least one of a) turning power on and off; and b) switching between various different lighting modes.

According to an embodiment of the present invention, the foot pedal further comprises fuses.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

FIG. 3B 2 is a cutaway side view of the multi-conductor male and female safety connectors when connected together showing how the movable side safety contacts have moved into contact with the fixed side terminals, completing the electrical path between the male and female electrical connectors.

DETAILED SPECIFICATION

The present invention generally relates to artificial lighted trees. Specifically, embodiments of the present invention provide for a decorative lighted Christmas tree with power routed through the trunk of the tree and three-wire safety grounding. The tree is divided into sections for easy assembly, disassembly, and storage. Safety electrical contacts at the ends of each section are not powered until the sections are assembled. The tree can also accommodate multiple lighting circuits utilizing different voltages simultaneously.

Figure 1:
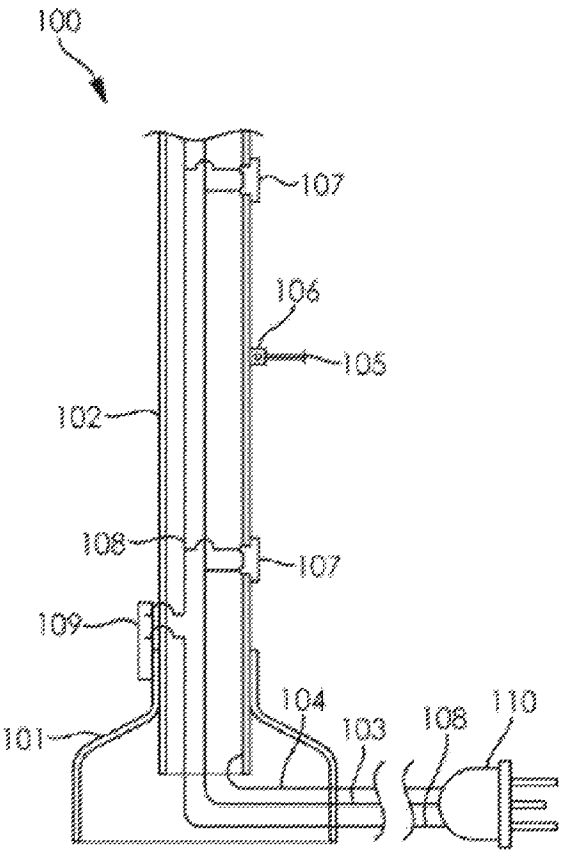
FIG. 1 is a view of the entire tree showing three-wire ground connections, and the various main parts of the tree.

According to an embodiment of the present invention, FIG. 1 shows an artificial lighted tree 100 comprising two primary parts: a base 101 and a trunk 102. One of ordinary skill in the art would recognize that the trunk and base may be attached to each other by a variety of means. Examples of attachment means include, but are not limited to, welding, screws, bolts, adhesives, or the trunk may merely be held upright by the base while resting on a surface. The trunk 102 is preferably electrically conductive or has an electrically conductive wall. To reduce the risk of electric shock, the tree 100 in FIG. 1 is safety grounded using a third wire that goes into the third hole in a grounded power outlet. As shown in FIG. 1, according to one embodiment of the present invention, grounding is accomplished by electrically connecting the neutral wire 103 to the ground wire 104 by attaching them both to the conductive trunk 102 of the tree 100. One of ordinary skill in the art would recognize there are a variety of ways to achieve proper grounding. The neutral wire 103 and the hot wire 108 then run up the inside of the trunk routing power to lights that decorate the tree. One of ordinary skill in the art would recognize that wires are not necessary, and any conductor can be used, including, but not limited to, printed circuits, conductive paints, conductive liquids, or ionized gases. Embodiments of the present invention may incorporate one or more of these conductors in lieu of or in conjunction with the wires.

Figure 5A:
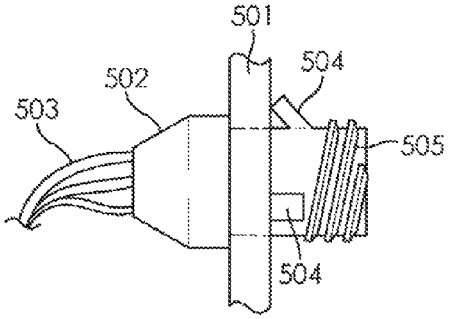
FIG. 5A shows a side profile view of the secondary connector in the side of the tree trunk for making power accessible from outside the tree trunk.
Figure 5B:
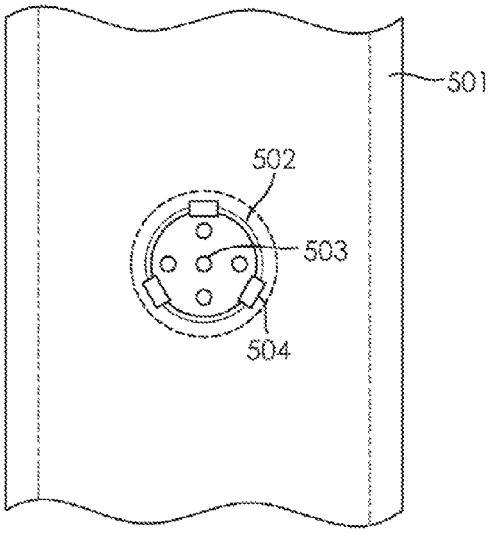
FIG. 5B shows a face view the secondary connector attached to the side of the tree trunk for making power accessible from outside the tree trunk.

FIG. 1 also shows a side electrical connector 107 which provides access to the hot wire 108 and neutral wire 103 inside the trunk 102 from outside the trunk 102. The side electrical connector 107 may be as simple as a wire, electrically connected to the wires 108, 104 inside the tree 100, and merely passing through a hole in the trunk 102 to the lights on the tree, or it may be a complex detachable multi-conductor connector as depicted in FIG. 5, described later in this specification. Another embodiment of the side electrical connector is shown in FIG. 7A. One of ordinary skill in the art would appreciate that there are numerous types of side electrical connectors that could be utilized with embodiments of the present invention, and embodiments of the present invention are contemplated for use with any appropriate type of side electrical connector.

According to a preferred embodiment of the present invention, the tree 100 also includes a branch attachment means 105. The branch attachment means 105 may permanently secure the branches to the tree or the branches may be removable. If the branches are permanently attached to the tree, they may be hinged 106 to allow the branches to fold upward for compact storage. Branch attachment means 105 may include, but are not limited to, screw fittings, snap fittings, hinged fittings, or any combination thereof. One of ordinary skill in the art would appreciate that there are numerous types of branch attachment means that could be utilized with embodiments of the present invention, and embodiments of the present invention are contemplated for use with any appropriate type of branch attachment means.

According to a preferred embodiment of the present invention in FIG. 1, a three-pronged plug 110 allows the entire tree 100 to be properly grounded when plugged into a grounded power outlet. Finally, a fuse box 109 attached to the side of the trunk 102 or the base 101 of the tree 100 houses appropriate fuses which will cut off power in case of a short or other electrical fault. Alternatively fuses may be housed inside an optional foot pedal controller shown in FIG. 6, or inside the plug 110 itself.

Figure 2:
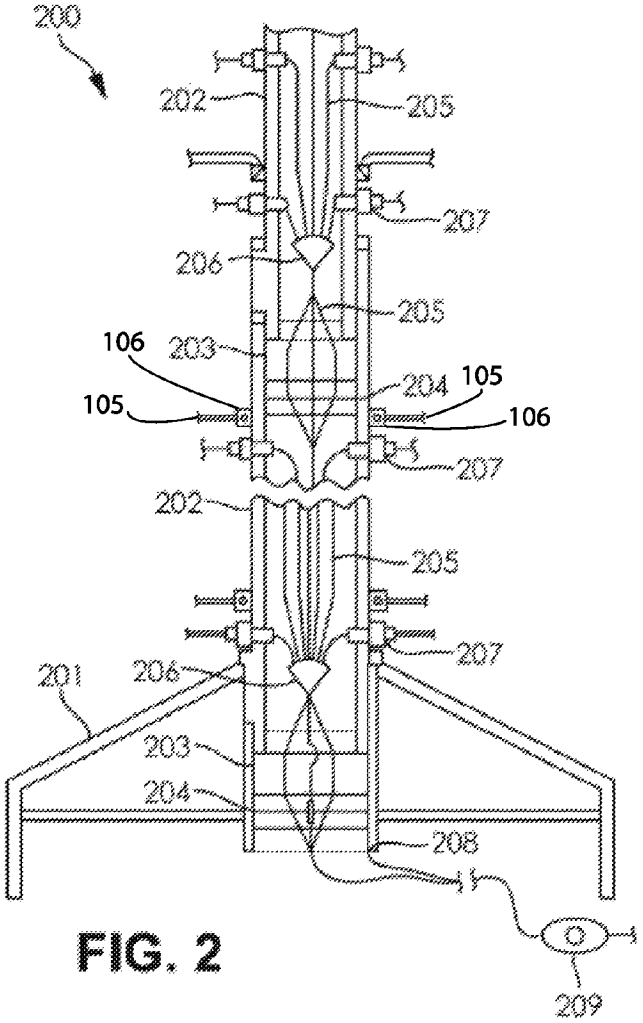
FIG. 2 shows the tree with multiple trunk sections and the detailed anatomy of a trunk section.

FIG. 2 shows the trunk of the tree 200 divided into separable trunk sections 202. According to an embodiment of the present invention, each trunk section has a male safety connector 203 in one end and a female safety connector 204 in the other end, allowing the trunk sections 202 to be assembled in any order. It is important to note that female electrical connectors and male electrical connectors are merely two connectors that connect to each other. Neither connector needs to be unambiguously anatomically male or female. So long as the connectors connect to each other, one may be accurately considered male and the other female. The trunk sections 202 need not all be of the same length. The male and female safety connectors 203, 204 are described in greater detail later in FIG. 3A-3E. The wires 205 connect the male safety connector 203 to the female safety connector 204, routing power to the side connectors and the next trunk section.

According to an embodiment of the present invention, The ground connection 208 is made in the base 201 itself which incorporates a female safety connector 204 to allow any trunk section 202 to connect to the base 201.

In a preferred embodiment of the present invention, a foot pedal 209 can be connected in line with the power cord to control the lighting of the tree. In other embodiments, the control of the lighting of the tree may be controlled by one or more control elements, such as a switch, a selector knob, an indicator panel, or any other human interface device (HID) or any combination thereof. One of ordinary skill in the art would appreciate that there are numerous types of control elements that could be utilized with embodiments of the present invention, and embodiments of the present invention are contemplated for use with any type of control element.

According to an embodiment of the present invention, a trunk section may also include a multi-conductor divider harness 206. This divider harness 206 allows power to be branched off to various multi-conductor divider harness side electrical connectors 207 and between the male safety connector 203 and the female safety connector 204. Alternatively, the divider harness 206 may enable the use of a plurality of circuits running at different voltages incorporated into the tree 200. With multiple circuits running through independent conductors, the user has the option of using both AC and DC voltages and a variety of different voltage levels simultaneously, including but not limited to 3 VDC, 5 VDC, 12 VDC, 24 VDC, 36 VDC, 120 VAC, 230 VAC, 50 Hz AC, or 60 Hz AC. When using multiple independent circuits, the divider harness 206 serves the function of routing the correct wires to the correct multi-conductor divider harness side electrical connectors 207 and between the male safety connector 203, and female safety connector 204. A multi-conductor safety connector will now be explained, referring to FIG. 3A-3C.

Figure 3B:
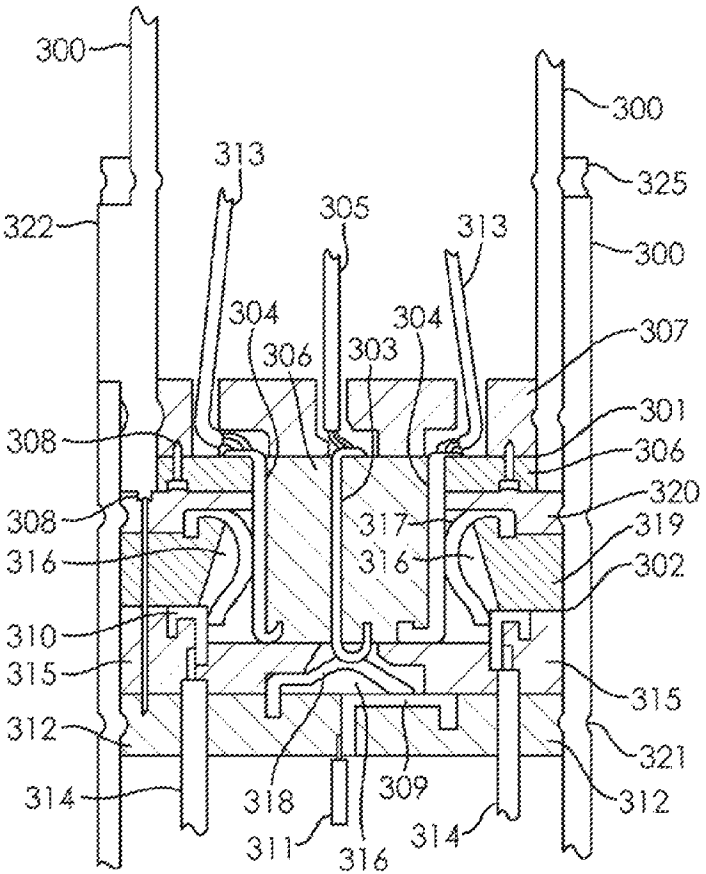
Figure 3A:
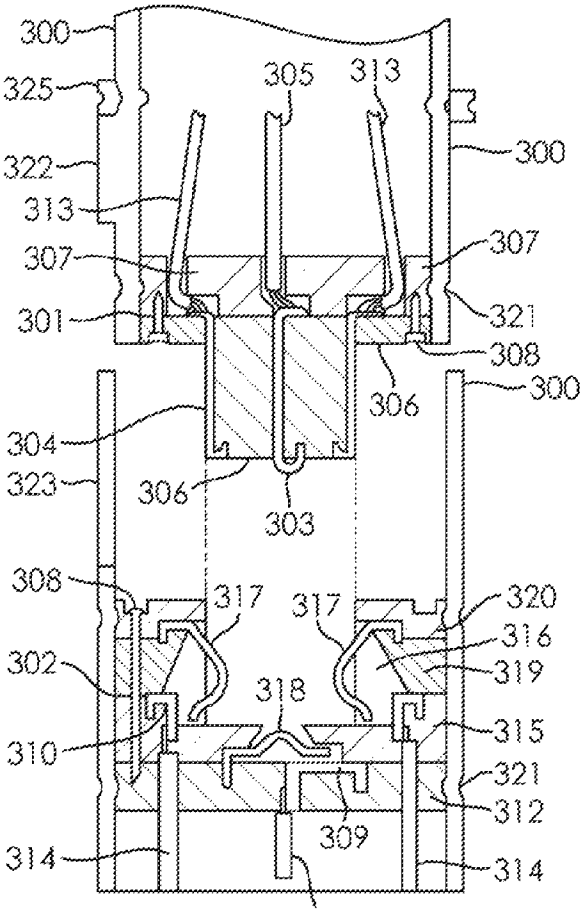
FIG. 3A is a cutaway side view of the multi-conductor male and female safety connectors showing how the movable side safety contacts are not powered when the male and female electrical connectors are disconnected from each other.

FIG. 3A shows the cutaway side view of the male electrical connector 301 and female electrical connector 302 components of the multi-conductor safety connector. The mechanics of the safety connector will now be explained. According to an embodiment of the present invention, the multi-conductor male electrical connector 301 contains a common center male contact terminal 303 and multiple side male contact terminals 304. These terminals 303, 304 are embedded in or attached to a male insulator 306. These terminals 303, 304 pass through the male insulator 306 and fold over to rest against the top surface of the male insulator 306, securing them in place and providing a larger contact surface for the outgoing wires 305, 313 to make electrical contact. A male wire insulator 307 has outgoing wires 305, 313 passing through L-shaped holes. When the male wire insulator 307 is fastened to the male terminal insulator 306 with screws 308, the ledge formed by the L-shaped hole presses the exposed tip of the outgoing center wire 305 against the top end of the center male contact terminal 303 and the outgoing side wires 313 against the top end of the side male contact terminals 304, creating electrical connections. Optionally, the wires 305, 313 may be soldered to the top ends of the terminals 303, 304. The bottom ends of the contact terminals 303, 304 will make contact with corresponding conductors (i.e., movable side safety contacts 317, movable center safety contact 318) on the multi-conductor female safety connector 302. The male connector is held together with screws and attached inside the trunk body 300 by securing indentations 321. Alternatively, the multi-conductor male safety connector 301 may be formed as a single piece with no screws, or as a snap-together assembly. One of ordinary skill in the art would recognize there are a variety of ways to form both the multi-conductor male connector 301 and the multi-conductor female safety connectors 302.

Referring now to the female electrical connector 302 in FIG. 3A, a fixed center terminal 309 is soldered to an incoming center wire 311 or held in electrical contact with an incoming center wire 311 by the female wire insulator 312. The incoming side wires 314 pass through the female wire insulator 312 and into the female terminal insulator 315, where they make an electrical connection, with or without soldering, with the fixed side terminals 310 embedded in the female terminal insulator 315. These fixed side terminals 310 and fixed center terminal 309 are folded in a hook shape with the ends embedded in the insulators 312, 315, exposing contact surfaces to air spaces 316. The fixed side terminals 310 and fixed center terminal 309 are situated in close proximity to the corresponding movable side safety contacts 317 and movable center safety contact 318 respectively.

According to an embodiment of the present invention, one end of the movable center safety contact 318 is fixed to the female wire insulator 312, and the other end hangs free, extending into an air space 316 in the female terminal insulator 315 above it. The free-hanging end is exposed to the open air, but recessed into the air space 316 in the exposed surface of the female terminal insulator 315. The movable center safety contact 318 is made of a resilient flexible conductor which bends under force and returns to its original position when the force is removed. When the multi-conductor male safety connector 301 connects to the multi-conductor female safety connector 302, as shown in FIG. 3B, the center male contact terminal 303 presses against the movable center safety contact 318, moving the free hanging end into electrical contact with the fixed center terminal 309.

Both the movable center safety contact 318 and the movable side safety contact need to be pressed down at the same time in order to complete the circuit and make a connection which provides for safety from most accidental insertion of foreign bodies into the female socket.

The movable side safety contacts 317 are arranged corresponding to their fixed side terminals 310 in much the same manner as described above. One end of each movable side safety contact 317 is fixed in place and held between the safety terminal insulator 319 and the female securing insulator 320. The other end floats freely, exposed in the adjacent air space 316. The entire multi-conductor female safety connector 302 assembly is held together with screw 308 and attached inside the trunk body 300 by securing indentations 321. Because the movable contacts 317, 318 are not in electrical contact with anything, they can be safely touched even when the trunk section 202 is powered. Looking now at FIG. 3B, when the trunk sections 202 are assembled, the movable contacts 317, 318 are pressed into a position of electrical contact with the fixed terminals 309, 310, passing power safely to the next trunk section.

According to an embodiment of the present invention, in order to prevent the multi-conductor male safety connector 301 being inserted too far, a limiting collar 325 is attached to the trunk body 300 at the appropriate distance. As shown in FIG. 3B, when the safety connector is connected, this limiting collar, abuts the trunk body 300 of the other trunk section and prevents excess insertion.

Figure 3D:
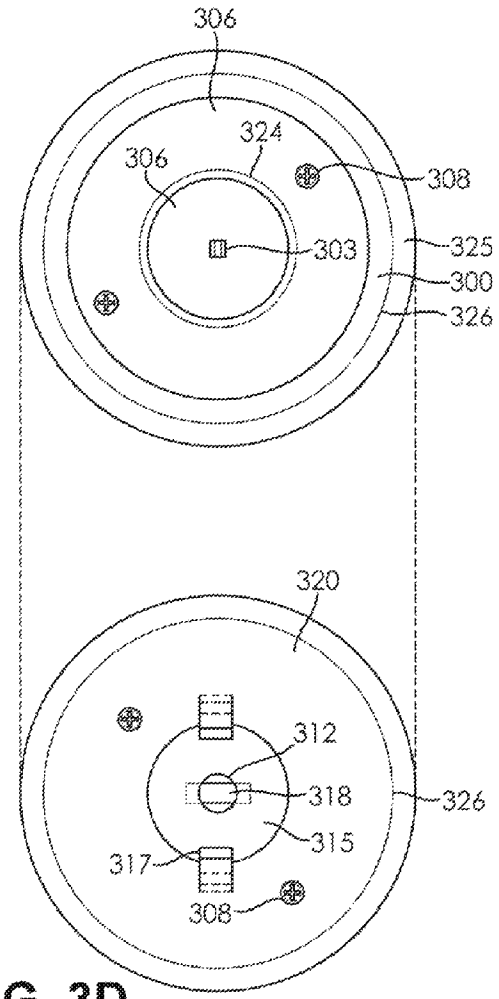
FIG. 3D is bottom and top view of the male and female safety connectors where the male electrical connector has a conductive ring, and the female electrical connector has redundant side connectors for ensuring a proper connection in a plurality of rotational orientations.
Figure 3C:
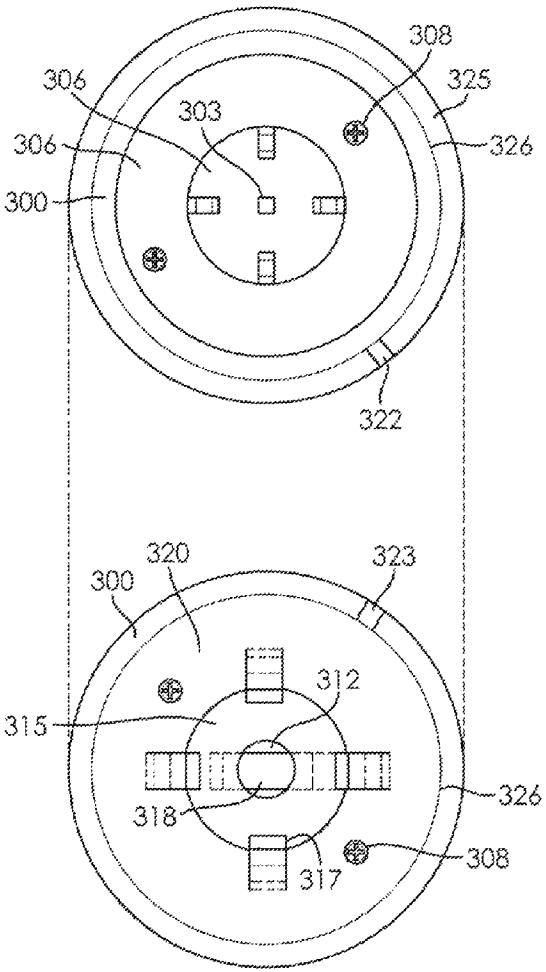
FIG. 3C is a bottom and top view of the multi-conductor male and female safety connectors respectively.

FIG. 3C shows the bottom view of the multi-conductor male safety connector 301, and the top view of the multi-conductor female safety connector 302. According to an embodiment of the present invention, the side terminals 304, 310 are arranged symmetrically and each side terminal 304, 310 corresponds to a separate circuit. In order to guarantee that the connectors 301, 302 are mated correctly, a key bar 322 on the body of the trunk section end with the multi-conductor male connector 301 slides into a key slot 323 cut into the body on the trunk section end with the female connector 302. If the key bar 322 and key slot 323 are not aligned, the trunk sections will not slide together. The key bar 322 and key slot 323 are also shown in the cutaway view of FIG. 3A-3B. One of ordinary skill in the art would recognize that the keying mechanism 322, 323 can be arranged in any way either on the trunk body 300 or on the male and female multi-conductor safety connectors 301, 302.

Figure 3E:
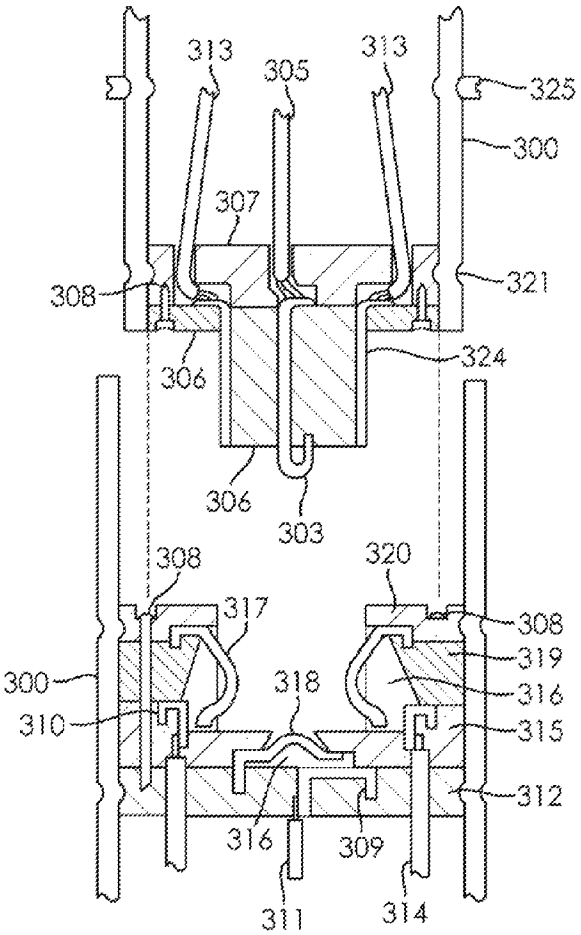
FIG. 3E is a cutaway side view of the male and female safety connectors where the male electrical connector has a conductive ring, and the female electrical connector has redundant side connectors for ensuring a proper connection in a plurality of rotational orientations.

According to an embodiment of the present invention, it is also possible to have a safety connector without accommodating multiple circuits, as depicted in FIG. 3D-3E. In FIG. 3D, the side male contact terminal 304 is a cylindrical ring 324. This cylindrical ring can make contact with the movable side safety contacts 317 of the multi-conductor female safety connector 302 in any rotational orientation. Since rotational orientation is not important in this particular embodiment, there is no need for a keying mechanism in FIG. 3D-3E. Because the movable side safety contacts 317 will both contact the same cylindrical ring 324, the side contacts 317 become redundant, making the connection more reliable and able to accommodate more power.

Figure 4:
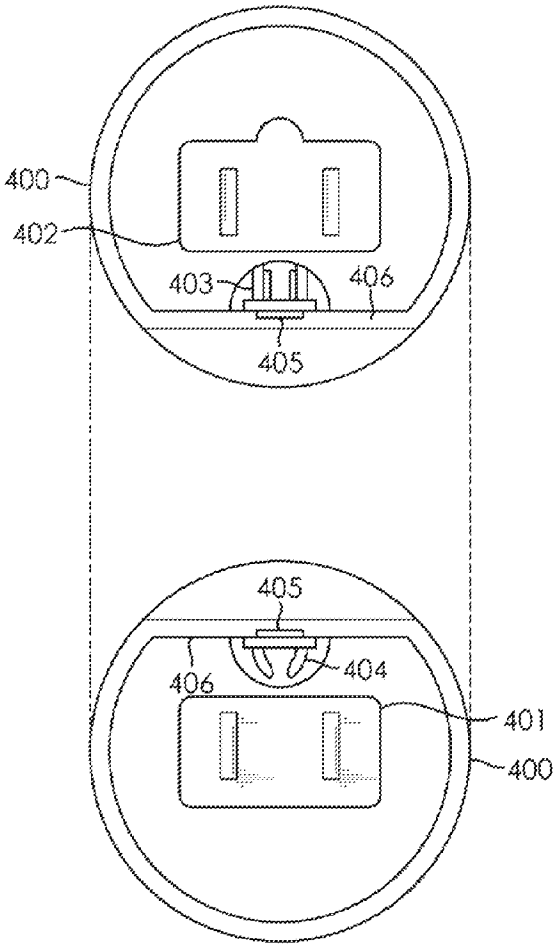
FIG. 4 is view of male and female plugs with a third electrical connection for ground.

According to an embodiment of the present invention depicted in FIG. 3D-3E, the trunk body 300 has bare metal surfaces 326 where the two trunk sections connect. This allows a direct electrical connection to between the conductive walls of the trunk sections when the pieces are fitted together. This not only eliminates the need for a separate grounding pin, as depicted in FIG. 4, but also produces a more reliable ground throughout the entire tree trunk so long as the contact areas are kept clean and free of corrosion. This direct electrical connection can be accomplished in a variety of ways, including, but not limited to a conductive paint, a conductive sleeve, or pattern of conductive traces. One of ordinary skill in the art would recognize that there are many ways to accomplish this direct electrical connection without departing from the spirit of the present invention.

FIG. 4 shows two-prong male 401 and female 402 connectors mounted inside the trunk sections 400. According to an embodiment of the present invention, a female ground clip 403 and a male ground pin 404 are spot welded 405 to their respective trunk sections. The trunk sections each have a flat side 406 that must be aligned with each other as a keying mechanism to ensure a properly grounded electrical connection. Another embodiment of the two-prong electrical connector incorporated into the tree is depicted in FIG. 7B. One of ordinary skill in the art would recognize that just about any type of electrical connector, of a combination of connectors could be used here to achieve proper grounding, while routing power where it is needed.

FIG. 5 represents a cutaway side view and a face view of the side electrical connector mentioned earlier in FIG. 1 (reference number 107) and FIG. 2 (reference number 207). According to an embodiment of the present invention, the side view electrical connector 502 contains multiple conductors 503 for powering multiple independent circuits simultaneously. With multiple circuits running through independent conductors, the user has the option of using both AC and DC voltages and a variety of different voltage levels simultaneously, including but not limited to 3 VDC, 5 VDC, 12 VDC, 24 VDC, 36 VDC, 120 VAC, 230 VAC, 50 Hz AC, or 60 Hz AC. In this particular embodiment of the present invention, the side view electrical connector 502 snaps into the trunk body 501 by means of a securing tab 504. One of ordinary skill in the art would recognize that such a sophisticated connector is not necessary. The task of routing power from inside the tree to outside the tree could also be accomplished with something as simple as a wire, electrically connected to the wires 103, 104 inside the tree, and passing through a hole in the trunk body. The connection could be either hard-wired or detachable. Another embodiment of a side connector incorporated into the tree is shown in FIG. 7B.

Figure 6:
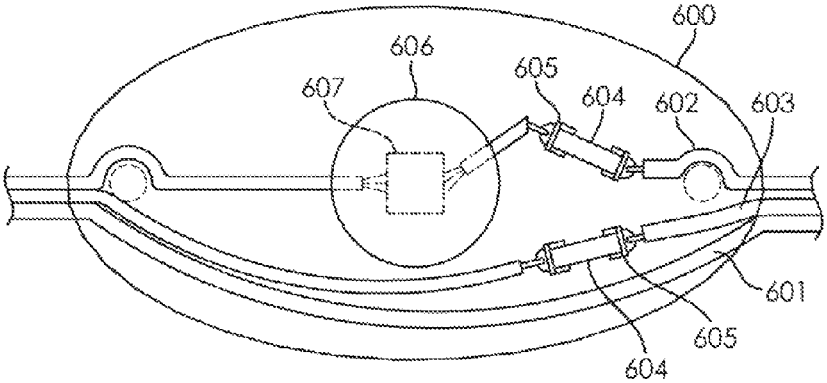
FIG. 6 shows a foot pedal switch with three-wire safety ground conductors running through it and fuses.

FIG. 6 shows the inside of the foot pedal 600 that can be used to control the lighting on the tree. According to an embodiment of the present invention, the foot pedal ground wire 601 passes straight through the food pedal, while the foot pedal hot wire 602 and the foot pedal neutral wire 603 both pass through fuses 604 mounted in fuse holders 605 within the pedal 600. The foot pedal hot wire also passes through a pushbutton 606 which can be used to turn the lights on and off or control the lighting mode. Although only one fuse is necessary, on the foot pedal hot wire 602, extension cords that do not have a ground conductor would prevent proper grounding, and the distinction between the foot pedal hot wire 602 and the foot pedal neutral wire 603 would become arbitrary. The fuse on the foot pedal neutral wire 603 provides an additional level of protection in case the foot pedal ground wire 601 is not properly grounded.

Figure 7:
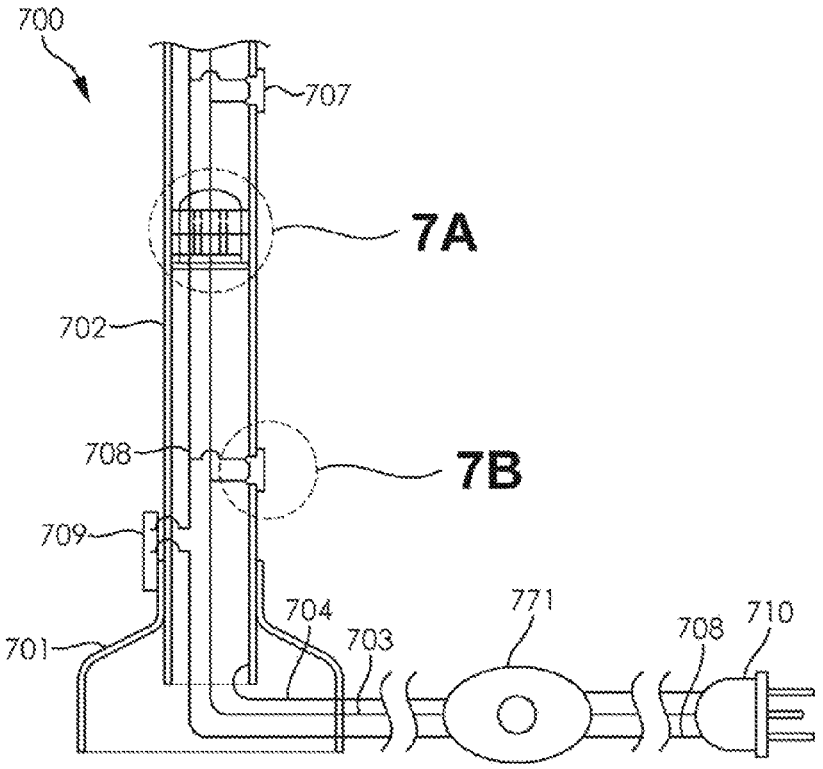
FIG. 7 shows the entire tree with side connectors and a two-prong connector between the trunk sections
Figure 7A:
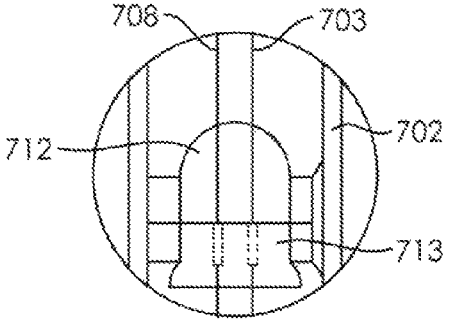
FIG. 7A shows the detail level of the two-prong connector from FIG. 7
Figure 7B:
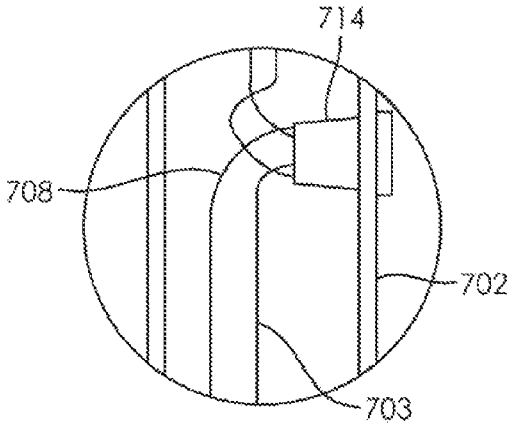
FIG. 7B shows the detail level of the side electrical connector from FIG. 7

FIG. 7 shows another embodiment of the entire tree 700 with two-prong electrical connectors, depicted in FIG. 7A, connecting the trunk sections. The trunk body 702 has a conductive wall and is held upright by the base 701. The two-prong electrical connector ground wire 704 is electrically connected to the conductive wall of the tree. The two-prong electrical connector hot wire 708 passes through a fuse in the fuse box 709. Alternatively, fuses may be housed inside the foot pedal 771.

Referring to FIG. 7B, the two-prong electrical connector side electrical connector 714 provides access to the two-prong electrical connector hot wire 708 and the two-prong electrical connector neutral wire 703 from outside the tree. This two-prong electrical connector side electrical connector 714 may be a polarized or non-polarized two-prong electrical connector or any kind of electrical connector that accomplishes the purpose of routing power from inside the tree to outside the tree. One of ordinary skill in the art would recognize there are a variety of ways to implement the two-prong electrical connector side electrical connector 714. The three-prong plug 110 allows for proper grounding when plugged into a grounded power outlet. An optional foot-pedal 771 allows for controlling the lights. In other embodiments, the control of the lighting of the tree may be controlled by one or more control elements, such as a switch, a selector knob, an indicator panel, or any other human interface device (HID) or any combination thereof. One of ordinary skill in the art would appreciate that there are numerous types of control elements that could be utilized with embodiments of the present invention, and embodiments of the present invention are contemplated for use with any type of control element.

In FIG. 7A, the male electrical connector 712 connects to the female electrical connector 713 inside the trunk body 702 of the tree.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A lighted artificial tree comprising:

a base, configured to receive and hold a trunk, wherein said trunk comprises:

a hollow body having an electrically conductive wall;

one or more inner electrical conductors situated inside said hollow body one or more side electrical connectors accessible from the outside of said hollow body and electrically connected to said inner electrical conductors;

a branch holding mechanism configured to attach one or more artificial tree branches to said trunk; and a ground conductor, electrically connected to said electrically conductive wall of said trunk;

wherein said trunk comprises at least a first trunk section and a section trunk section, said trunk sections each comprising:

a hollow body having an electrically conductive wall;

a male electrical connector attached inside a first end of said hollow body;

a female electrical connector attached inside a second end of said hollow body;

one or more inner electrical conductors connecting said female connector to said male connector, wherein said male electrical connector of the first trunk section connects to said female electrical connector of the second trunk section, wherein the electrically conductive walls of the first trunk section and the second trunk section are electrically connected, wherein said first and second trunk section male electrical connectors each comprise:

a center male contact terminal;

one or more side male contact terminals; and wherein said first and second trunk section female electrical connectors each comprise:

a fixed center terminal;

a movable center safety contact, wherein the second trunk section movable center safety contact is configured to move into electrical contact with said second trunk section fixed center terminal when said first trunk section center male contact terminal contacts said second trunk section movable center safety contact;

one or more fixed side terminals; and one or more movable side safety contacts, wherein said one or more second trunk section movable side safety contacts are configured to move into electrical contact with said one or more second trunk section fixed side terminals when said one or more first trunk section side male contact terminals contact said one or more second trunk section movable side safety contacts, wherein said first trunk section male electrical connector comprises a male ground contact corresponding to a female ground contact in said second trunk section female electrical connector for creating an electrical connection between the electrically conductive walls of said first trunk section and said second trunk section.

2. The tree of claim 1 wherein the electrically conductive wall of said first trunk section makes a direct electrical connection with the electrically conductive wall of said second trunk section when the two trunk sections are connected together.

3. The tree of claim 1 wherein said second trunk section movable center safety contact is not energized until said first trunk section male electrical connector and said second trunk section female electrical connector are connected together causing said second trunk section movable center safety contact to move into contact with said second trunk section fixed center terminal and said second trunk section one or more movable side safety contacts to move into contact with said second trunk section one or more fixed side terminals.

4. The tree of claim 1 further comprising multiple independent power conductors for running a plurality of different voltages.

5. The tree of claim 1 further comprising a foot pedal configured for at least one of a) turning power on and off; and b) switching between various different lighting modes.

6. The tree of claim 4 wherein said foot pedal further comprises fuses.

* * * * *